US008957753B2

(12) United States Patent
Odehnal et al.

(10) Patent No.: US 8,957,753 B2
(45) Date of Patent: Feb. 17, 2015

(54) CURRENT TRANSFORMER

(75) Inventors: Martin Odehnal, Brno (CZ); Roman Pernica, Brno (CZ); Pavel Vano, Brno (CZ)

(73) Assignee: ABB Technology AG, Zurich (CH)

( * ) Notice: Subject to any disclaimer, the term of this patent is extended or adjusted under 35 U.S.C. 154(b) by 404 days.

(21) Appl. No.: 13/302,400

(22) Filed: Nov. 22, 2011

(65) Prior Publication Data

US 2013/0127581 A1 May 23, 2013

(51) Int. Cl.

| | |
|---|---|
| ***H01F 38/20*** | (2006.01) |
| ***H01F 17/06*** | (2006.01) |
| ***H01F 27/32*** | (2006.01) |
| ***H01F 38/30*** | (2006.01) |
| ***H01F 27/28*** | (2006.01) |

(52) U.S. Cl.

CPC ..... *H01F 38/30* (2013.01); *H01F 27/289* (2013.01); *H01F 2038/305* (2013.01)

USPC ..... 336/173; 336/84 R; 336/84 C; 336/84 M; 336/174; 336/175

(58) Field of Classification Search

USPC ..... 336/84 R, 84 C, 84 M, 173–175

See application file for complete search history.

(56) References Cited

U.S. PATENT DOCUMENTS 3,495,264 A * 2/1970 Spears ..... 343/788
2005/0242916 A1* 11/2005 So ..... 336/200

FOREIGN PATENT DOCUMENTS

GB 2148609 A * 5/1985

* cited by examiner

*Primary Examiner* — Tsz Chan

(74) *Attorney, Agent, or Firm* — Buchanan Ingersoll & Rooney PC

(57) ABSTRACT

Exemplary embodiments are directed to a current transformer having a toroidal magnetic core around which an even number of shielding coils is wound. The shielding coils are operatively associated two by two to form corresponding couples. The shielding coils of each couple are wound on parts of the toroidal magnetic core opposite to each other and are connected in parallel to each other for obtaining a magnetic flux in them. The magnetic flux in a first shielding coil of a couple of shielding coils has an opposite direction with respect to a magnetic flux in a second shielding coil of the couple. The couples of shielding coils are connected in series.

18 Claims, 3 Drawing Sheets

CURRENT TRANSFORMER

FIELD

The present disclosure relates to transformer, such as a current transformer, with an arrangement of windings for eliminating or at least reducing local core saturation.

BACKGROUND

Known current transformers include a toroidal core inside which a primary conductor passes. A secondary or working winding is wound around the core with regularly displayed turns without a sectional winding, i.e. without dividing a winding into individual sections. This type of layout is subject to influences of outside magnetic fields, or misalignment, deviation, or insufficiencies of a primary conductor. These outside influences cause local oversaturation of the magnetic core, thus resulting in inaccuracies of the current transformer.

Thus, it is desirable to provide a solution which faces these issues and allows further improvements over known devices, and in particular with regard to elimination or at least reduction of local core saturation.

SUMMARY

An exemplary current transformer is disclosed comprising: a toroidal magnetic core; and an even number of shielding coils which are wound around said toroidal magnetic core, wherein said shielding coils are arranged two by two in order to form corresponding couples and the two shielding coils of each couple are wound on opposite parts of the toroidal magnetic core, the shielding coils in each couple being connected in parallel to establish a respective magnetic flux in each coil, wherein the magnetic flux in the first shielding coil of each couple of shielding coils has an opposite direction with respect to the magnetic flux in the second shielding coil of each couple of shielding coils, and wherein the couples of shielding coils are connected in series.

Another exemplary current transformer is disclosed comprising: a toroidal magnetic core; and plural pairs of shielding coils, wherein each pair forms a shielding coil couple, wherein each shielding coil is wound around said toroidal magnetic core, corresponding couples and the two shielding coils of each couple are wound on opposite parts of the toroidal magnetic core, and for each shielding coil couple the shielding coils are connected in parallel, wherein a magnetic flux in a first shielding coil of each shielding coil couple has an opposite direction with respect to a magnetic flux in a second shielding coil of each shielding coil couple, and wherein the shielding coil couples are connected in series.

DESCRIPTION OF THE DRAWINGS

Further characteristics and advantages will become apparent from the description of some but not exclusive exemplary embodiments of a current transformer according to the present disclosure, illustrated only by way of non-limitative examples with the accompanying drawings, wherein.

Figure 1:
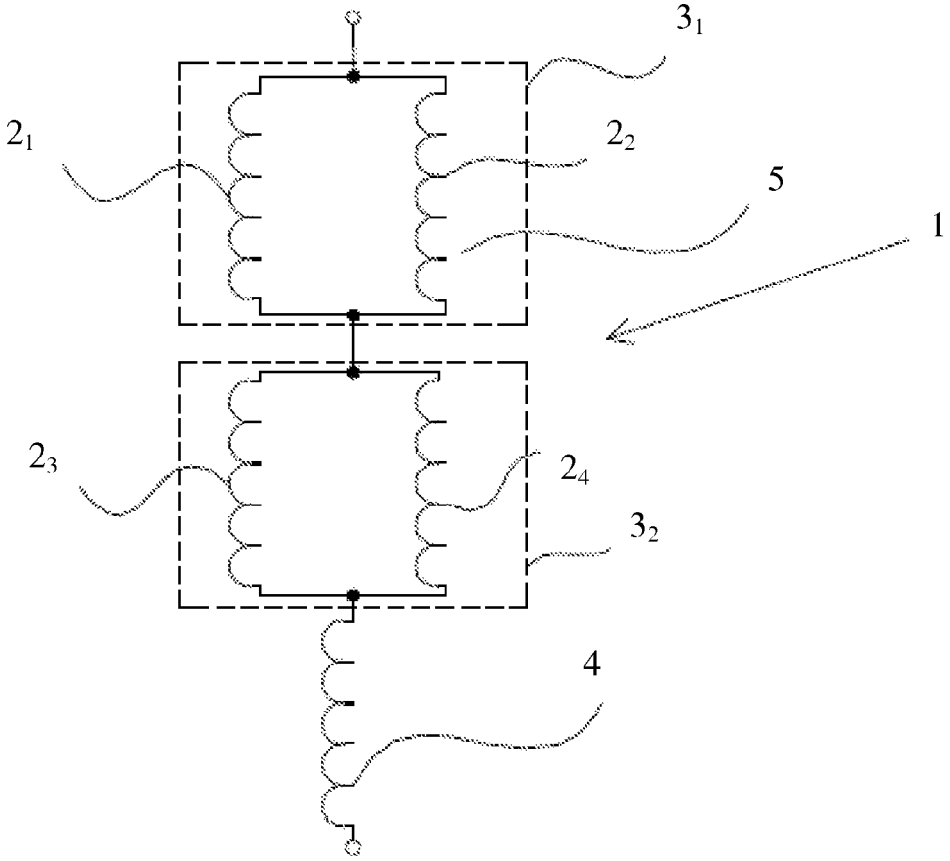
FIG. 1 shows a first wiring diagram of an arrangement of windings of a current transformer in accordance with an exemplary embodiment.

It should be noted that in the detailed description that follows, identical or similar components, either from a structural and/or functional point of view, have the same reference numerals, regardless of whether they are shown in different embodiments of the present disclosure; it should also be noted that in order to clearly and concisely describe the present disclosure, the drawings may not necessarily be to scale and certain features of the disclosure may be shown in somewhat schematic form.

DETAILED DESCRIPTION

A solution over the prior art provides an exemplary current transformer having a toroidal magnetic core and an even number of shielding coils which are wound around the toroidal magnetic core, wherein the shielding coils are associated two by two to form corresponding couples and the two shielding coils of each couple are wound on parts of the toroidal magnetic core opposite to each other. The shielding coils in each couple of shielding coils can be connected in parallel to each other to establish a magnetic flux in them. The magnetic flux in the first shielding coil in each couple of shielding coils has an opposite direction with respect to the magnetic flux in the second shielding coil of the same couple of shielding coils, the couples of shielding coils being connected in series to each other.

The fact that a magnetic flux in one shielding coil in a coil couple has the opposite direction with respect to the magnetic flux in the other shielding coil of the same coil couple could be obtained by winding the shielding coils in the same direction or by winding the shielding coils in an opposite direction. For example, in order to achieve such an effect it is possible to wind a coil clockwise, counter-clockwise, from inside the core, or from outside the core, and correspondingly realize the interconnection among the coil tags according to solutions well known or readily available to those skilled in the art and therefore not described in detail herein.

For instance, in an exemplary embodiment, winding around the toroidal magnetic core can be in the same direction.

In exemplary embodiments of the present disclosure, the shielding coils can be arranged around the circumference of a toroidal magnetic core next to each other, or one over the other with an angular offset or overlap, and more preferably with an angular overlap or offset of about 90°, for example.

In another exemplary embodiment of the present disclosure the individual couples of shielding coils form at least a part of the secondary or working winding or the whole working winding of the current transformer.

The number of turns of the shielding coils can be the same for all shielding coils.

FIG. 1 shows a first wiring diagram of an arrangement of windings of a current transformer in accordance with an exemplary embodiment. In a current transformer 1 an even number of shielding coils are wound around a toroidal core 5. The shielding coils are associated two by two to former respective couples. The two shielding coils of each couple are wound around the toroidal core 5 on opposite parts of each other with respect to a reference axis 100, or 200, or 300 as it will be better described hereinafter.

The shielding coils of each couple are connected in parallel to each other.

The Couples Formed are then Connected in Series.

Figure 2:
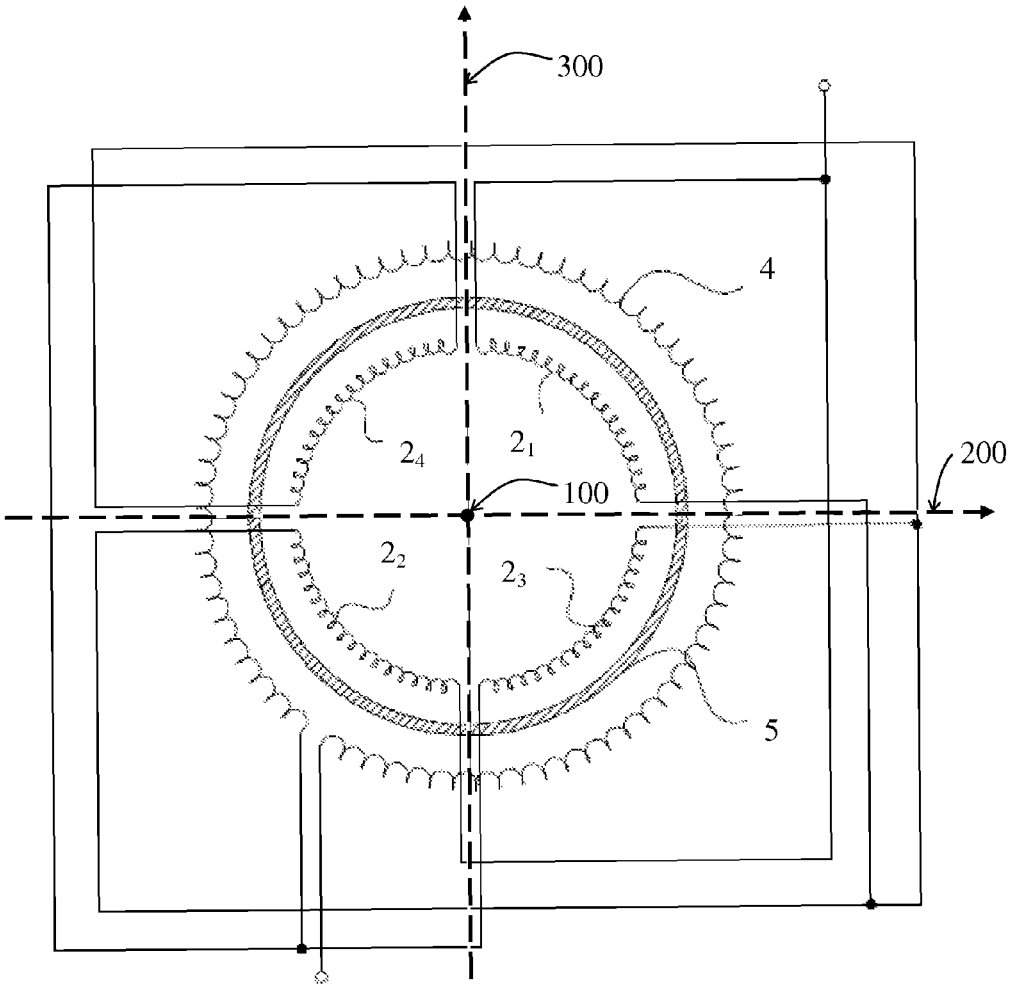
FIG. 2 is a view schematically showing a current transformer with a first winding arrangement in accordance with an exemplary embodiment.
Figure 3:
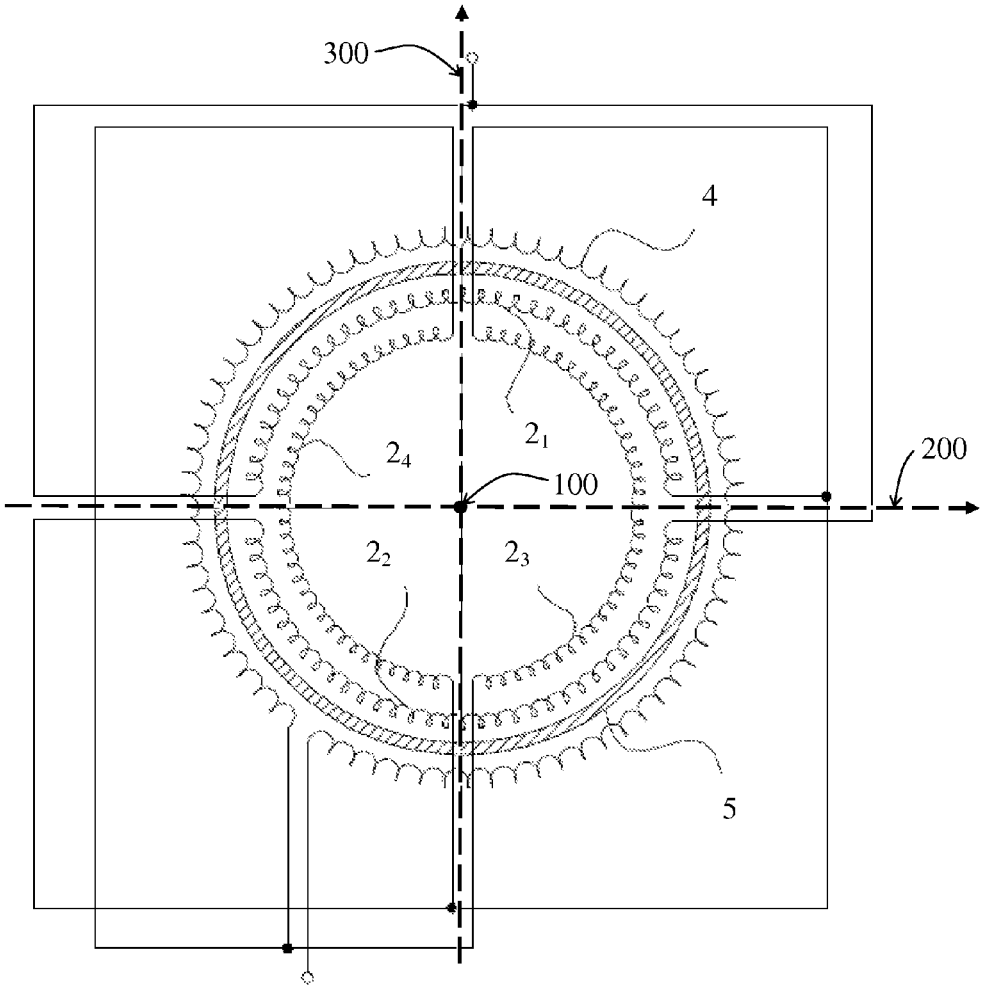
FIG. 3 is a view schematically showing a current transformer with a second winding arrangement in accordance with an exemplary embodiment.

FIG. 2 is a view schematically showing a current transformer with a first winding arrangement in accordance with an exemplary embodiment. FIG. 3 is a view schematically showing a current transformer with a second winding arrangement in accordance with an exemplary embodiment. In particular, FIGS. 2 and 3 illustrate four shielding coils $\mathbf{2}_1$ to $\mathbf{2}_4$. The shielding coils $\mathbf{2}_1$, $\mathbf{2}_2$ are wound opposite to each other and form couple $\mathbf{3}_1$, and the shielding coils $\mathbf{2}_3$, $\mathbf{2}_4$ are wound opposite to each other, and form couple $\mathbf{3}_2$. The shielding coils $\mathbf{2}_1$ to $\mathbf{2}_4$ are arranged around the whole circumference of the toroidal magnetic core 5 next to each other so that each shielding coil $\mathbf{2}_1$ to $\mathbf{2}_4$ occupies one quarter of the whole circumference of the toroidal magnetic core 5.

As shown in FIG. 2, the shielding coils $\mathbf{2}_1$, and $\mathbf{2}_2$ are positioned on the toroidal core 5 opposite to each other with respect to a reference axis 100 passing through the centre of the core 5 and directed perpendicularly with respect to the plane of the drawing sheet (first and third quarters, respectively); the same applies to the shielding coils $\mathbf{2}_3$ and $\mathbf{2}_4$ which are positioned around the core opposite to each other with respect to the centre at the fourth and second quarters, respectively).

In the exemplary embodiment of FIG. 2, the shielding coils $\mathbf{2}_1$, $\mathbf{2}_2$ of each couple $\mathbf{3}_1$ are connected in parallel to each other. Likewise the shielding coils $\mathbf{2}_3$, $\mathbf{2}_4$ of each couple $\mathbf{3}_2$ are connected in parallel to each other.

The contact ends of the shielding coil $\mathbf{2}_1$ can be connected with respective contact ends of the opposite shielding coil $\mathbf{2}_2$ in the couple $\mathbf{3}_1$. Similarly, the contact ends of the shielding coil $\mathbf{2}_3$ can be connected with respective contact ends of the opposite shielding coil $\mathbf{2}_4$ in the couple $\mathbf{3}_2$.

As a result of this wiring layout, a magnetic flux in shielding coils $\mathbf{2}_1$ to $\mathbf{2}_4$ is obtained that has the opposite direction in shielding coils $\mathbf{2}_1$ and $\mathbf{2}_2$ of the couple $\mathbf{3}_1$ of shielding coils $\mathbf{2}_1$ to $\mathbf{2}_2$ and in shielding coils $\mathbf{2}_3$ and $\mathbf{2}_4$ of the couple $\mathbf{3}_2$ of shielding coils $\mathbf{2}_3$ to $\mathbf{2}_4$, and the couples $\mathbf{3}_1$, $\mathbf{3}_2$ of shielding coils $\mathbf{2}_1$ to $\mathbf{2}_4$ are connected in series.

The secondary or working winding of the current transformer can either be formed only by shielding coils $\mathbf{2}_1$ to $\mathbf{2}_4$ in couples $\mathbf{3}_1$, $\mathbf{3}_2$ or there can be another supplementary winding 4 connected in series with couples $\mathbf{3}_1$, $\mathbf{3}_2$ of shielding coils $\mathbf{2}_1$ to $\mathbf{2}_4$; in the latter case, the working winding of the current transformer then comprises (e.g., consists of) couples $\mathbf{3}_1$, $\mathbf{3}_2$ of shielding coils $\mathbf{2}_1$ to $\mathbf{2}_4$ plus the supplementary winding 4 which is also wound around the toroidal magnetic core 5.

The four shielding coils $\mathbf{2}_1$ to $\mathbf{2}_4$ and the supplementary winding 4 can be interconnected in the same way as it is shown in FIG. 1 and the opposite contact ends in each couple $\mathbf{3}_1$, $\mathbf{3}_2$ of shielding coils $\mathbf{2}_1$ to $\mathbf{2}_4$ can be connected to each other.

In the exemplary embodiment of FIG. 3 the four shielding coils $\mathbf{2}_1$ to $\mathbf{2}_4$ and the supplementary winding 4 in the current transformer 1 can be wound around the toroidal magnetic core 5 so that each of the two couples $\mathbf{3}_1$, $\mathbf{3}_2$ of shielding coils $\mathbf{2}_1$ to $\mathbf{2}_4$ and also the additional winding 4, when present, can be arranged around the whole circumference of the toroidal magnetic core 5. The first shielding coil $\mathbf{2}_1$ of the first couple $\mathbf{3}_1$ can be wound on one half of the toroidal magnetic core 5, while the second shielding coil $\mathbf{2}_2$ of the first couple $\mathbf{3}_1$ can be wound on the other half of the toroidal magnetic core 5.

In this arrangement the first shielding coil $\mathbf{2}_1$ and the second shielding coil $\mathbf{2}_2$ of the first couple $\mathbf{3}_1$ are positioned on the core 5 opposite to each other with respect to a reference axis 200. In turn, the first shielding coil $\mathbf{2}_3$ and the second shielding coil $\mathbf{2}_4$ of the second couple $\mathbf{3}_2$ can be positioned on the core 5 opposite to each other with respect to a reference axis 300.

The first couple $\mathbf{3}_1$ formed by the shielding coils $\mathbf{2}_1$ and $\mathbf{2}_2$ can occupy the whole circumference of the toroidal magnetic core 5. Similarly, the first shielding coil $\mathbf{2}_3$ of the second couple $\mathbf{3}_2$ can be wound on one half of the toroidal magnetic core 5, while the second shielding coil $\mathbf{2}_4$ of the second couple $\mathbf{3}_2$ can be wound on the other half of the toroidal magnetic core 5. From this arrangement, the second couple $\mathbf{3}_2$ formed by the shielding coils $\mathbf{2}_3$ and $\mathbf{2}_4$ can occupy the whole circumference of the toroidal magnetic core 5. The windings or shielding coils of the first couple $\mathbf{3}_1$ and of the second couple $\mathbf{3}_2$ are wound on each other with an angular overlap of about 90° for example. The four shielding coils $\mathbf{2}_1$ to $\mathbf{2}_4$ and the supplementary winding 4 are interconnected in the same way as it is shown in FIG. 1.

In an exemplary embodiment of the present disclosure reference is made, for example, to the axis 200 and counting either clockwise and/or counter-clockwise, the ends of each shielding coil in a first couple of coils, e.g. the ends of the shielding coil $\mathbf{2}_1$ and/or of the shielding coil $\mathbf{2}_2$ of the couple $\mathbf{3}_1$, are offset at about 90° with respect to the ends of each shielding coil in a second couple of coils, e.g. the ends of the shielding coil $\mathbf{2}_3$ and/or of the shielding coil $\mathbf{2}_4$ of the couple $\mathbf{3}_2$.

It should be understood that such an angular offset or overlap can have a different value other than 90°.

In operation, if for example the primary conductor is not in the centre of the current transformer 1, the magnetic field of the primary conductor can increase the magnetic flow in the magnetic material of the toroidal magnetic core 5 up to the saturation point. At the same time, the magnetic field of the primary conductor induces a current in the shielding coils $\mathbf{2}_1$ to $\mathbf{2}_4$ the value of which is increasing with the closeness of the primary conductor to the respective shielding coil $\mathbf{2}_1$ to $\mathbf{2}_4$. The bigger the deviation of the primary conductor from the centre of the toroidal magnetic core 5, the bigger the induced current in the closest one of the shielding coils $\mathbf{2}_1$ to $\mathbf{2}_4$. The magnetic flow induced in the toroidal magnetic core 5 by the shielding coils $\mathbf{2}_1$ to $\mathbf{2}_2$ is in the opposite direction with respect to each other. Both opposite shielding coils $\mathbf{2}_1$ and $\mathbf{2}_2$ or $\mathbf{2}_3$ and $\mathbf{2}_4$ mutually cooperate—namely one of them adds a magnetic flow where it is missing or low in the toroidal magnetic core 5 and the other one reduces the magnetic flow on the other side of the toroidal magnetic core 5, where the magnetic flow is excessive.

In other words, the electric flow in the primary conductor induces an electric tension in the shielding coils $\mathbf{2}_1$ to $\mathbf{2}_4$. As the shielding coils $\mathbf{2}_1$ and $\mathbf{2}_2$ are connected in parallel and similarly the shielding coils $\mathbf{2}_3$ and $\mathbf{2}_4$ are connected in parallel, the electric tension on the shielding coil $\mathbf{2}_1$ is identical with that on the shielding coil $\mathbf{2}_2$ and the same electric current flows through both shielding coils $\mathbf{2}_1$ and $\mathbf{2}_2$; likewise, the electric tension on the shielding coil $\mathbf{2}_3$ is identical with that on the shielding coil $\mathbf{2}_4$ and through both shielding coils $\mathbf{2}_3$ and $\mathbf{2}_4$ flows the same electric current. The magnetic flow induced in the shielding coils $\mathbf{2}_1$ and $\mathbf{2}_2$ and in the shielding coils $\mathbf{2}_3$ and $\mathbf{2}_4$ adds a magnetic flow where it is missing or low in the toroidal magnetic core 5 and reduces the magnetic flow on the other side of the toroidal magnetic core 5, where the magnetic flow is excessive.

Shielding coils $\mathbf{2}_1$ to $\mathbf{2}_4$ form only parts of the working winding and they are connected in series with the supplementary winding 4. The number of turns is the same in all shielding coils $\mathbf{2}_1$ to $\mathbf{2}_4$ and in this exemplary embodiment each shielding coil $\mathbf{2}_1$ to $\mathbf{2}_4$ has x turns, where x is a number in the order of hundreds to thousands, while the supplementary winding 4 has y turns, where y is in the order of thousands, depending on the specified transformer ratio.

An exemplary current transformer according to the present disclosure gives some improvements over the existing devices, allowing the disclosed embodiments to overcome the issues of the prior art previously mentioned, since it makes possible to at least reduce if not completely eliminate the problem of local core saturation.

The exemplary current transformer disclosed herein is susceptible of modifications and variations, all of which are within the scope of the inventive concept including any combination of the above described embodiments; for example, the number of shielding coils $\mathbf{2}_1$ to $\mathbf{2}_4$, that is four in the described exemplary embodiment, could be any even number, and their positioning is used for optimisation of the whole set-up based on the specified level of saturation.

All details may further be replaced with other technically equivalent elements; in practice, the materials, so long as they are compatible with the specific use, as well as the individual components, may be any according to the specifications and the state of the art.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A current transformer comprising:

a toroidal magnetic core; and an even number of shielding coils which are wound around said toroidal magnetic core, wherein said shielding coils are arranged two by two in order to form corresponding couples and the two shielding coils of each couple are wound on opposite parts of the toroidal magnetic core, the shielding coils in each couple being connected in parallel to establish a respective magnetic flux in each coil, wherein the magnetic flux in a first shielding coil of each couple has an opposite direction with respect to the magnetic flux in a second shielding coil of each couple, and wherein the couples are connected in series.

2. The current transformer according to claim 1, wherein said shielding coils are arranged in sequence next to each other around a circumference of the toroidal magnetic core.

3. The current transformer according to claim 1, wherein each couple is arranged around a circumference of the toroidal magnetic core, and wherein a first couple of shielding coils is wound on a second couple of shielding coils with an angular offset.

4. The current transformer according to claim 3, wherein the first couple of shielding coils is wound on the second couple with an angular offset of 90°.

5. The current transformer according to claim 1, wherein the couples of shielding coils form at least a part of the secondary winding of the current transformer.

6. The current transformer according to claim 5, wherein the secondary winding of the current transformer includes said shielding coils.

7. The current transformer according to claim 1, wherein the shielding coils of at least one couple of shielding coils are wound in a same direction, wherein opposite coil ends in each couple of shielding coils are connected so that the magnetic flux in the first shielding coil of a couple is in an opposite direction of the magnet flux in the second shielding coil of said couple.

8. The current transformer according to claim 1, wherein the shielding coils are wound in opposite directions, the opposite coil ends in each couple of shielding coils are connected to each other so that the magnetic flux in the first shielding coil of a couple is in an opposite direction of the magnet flux in the second shielding coil of said couple.

9. The current transformer according to claim 1, wherein a number of turns of each shielding coil is equal for all shielding coils.

10. A current transformer comprising:

a toroidal magnetic core; and plural pairs of shielding coils, wherein each pair forms a shielding coil couple, wherein each shielding coil is wound around said toroidal magnetic core, corresponding couples and the two shielding coils of each couple are wound on opposite parts of the toroidal magnetic core, and for each shielding coil couple the shielding coils are connected in parallel, wherein a magnetic flux in a first shielding coil of each shielding coil couple has an opposite direction with respect to a magnetic flux in a second shielding coil of each shielding coil couple, and wherein the shielding coil couples are connected in series.

11. The current transformer according to claim 10, wherein the shielding coils of each shielding coil couple are arranged in sequence next to each other around a circumference of the toroidal magnetic core.

12. The current transformer according to claim 10, wherein each shielding coil couple is arranged around a circumference of the toroidal magnetic core, and wherein a first shielding coil couple is wound on a second shielding coil couple with an angular offset.

13. The current transformer according to claim 12, wherein the first of shielding coil couple is wound on the second shielding coil couple with an angular offset of 90°.

14. The current transformer according to claim 10, wherein the shielding coil couples form at least a part of the secondary winding of the current transformer.

15. The current transformer according to claim 14, wherein the secondary winding of the current transformer includes said shielding coils.

16. The current transformer according to claim 10, wherein the shielding coils of at least one shielding coil couple are wound in a same direction, and wherein opposite coil ends in each shielding coil couple are connected so that the magnetic flux in the first shielding coil of a shielding coil couple is in an opposite direction of the magnet flux in the second shielding coil of said shielding coil couple.

17. The current transformer according to claim 10, wherein the shielding coils are wound in opposite directions, the opposite coil ends in each couple of shielding coils are connected to each other so that the magnetic flux in the first shielding coil of a couple of coils is in an opposite direction of the magnet flux in the second shielding coil of said couple of coils.

18. The current transformer according to claim 10, wherein the shielding coils include an equal number of turns.

* * * * *